US010824092B1

(12) United States Patent
Kurita

(10) Patent No.: US 10,824,092 B1
(45) Date of Patent: Nov. 3, 2020

(54) IMAGE FORMING APPARATUS AND METHOD FOR ESTIMATING DISCARDED RECORDING MATERIAL

(71) Applicant: TOSHIBA TEC KABUSHIKI KAISHA, Tokyo (JP)

(72) Inventor: Suguru Kurita, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/566,505

(22) Filed: Sep. 10, 2019

(51) Int. Cl.
*G03G 15/08* (2006.01)
*G03G 15/01* (2006.01)
*G03G 21/12* (2006.01)

(52) U.S. Cl.
CPC ..... *G03G 15/0856* (2013.01); *G03G 15/0131* (2013.01); *G03G 21/12* (2013.01); *G03G 2215/00029* (2013.01)

(58) Field of Classification Search
CPC ..... G03G 15/0856; G03G 15/0131; G03G 21/12; G03G 21/105
See application file for complete search history.

(56) References Cited

U.S. PATENT DOCUMENTS 5,918,085 A * 6/1999 Rollins ..... G03G 21/12 399/27
7,734,203 B2 6/2010 Tanaka

* cited by examiner

*Primary Examiner* — Hoang X Ngo
(74) *Attorney, Agent, or Firm* — Kim & Stewart LLP

(57) ABSTRACT

An image forming apparatus includes an image forming unit, a sensor, and a controller. The image forming unit is configured to form a toner image on an image carrier based on image data and transfer the toner image on the image carrier onto a sheet. The sensor is positioned to measure an amount of toner on the image carrier before or after transfer of the toner image onto the sheet. The controller is configured to determine a remaining amount of toner that is discarded or wasted based on the measured amount.

20 Claims, 3 Drawing Sheets

| HUMIDITY | CURRENT | CORRECTION VALUE ACCORDING TO ENVIRONMENTAL FACTOR |
|---|---|---|
| | | |
| ⋮ | ⋮ | ⋮ |

| NUMBER OF MOTOR ROTATIONS | CORRECTION FACTOR |
|---|---|
| | |
| ⋮ | ⋮ |

IMAGE FORMING APPARATUS AND METHOD FOR ESTIMATING DISCARDED RECORDING MATERIAL

FIELD

Embodiments described herein relate generally to an image forming apparatus and a discarded recording material estimation method.

BACKGROUND

In the related art, an image forming apparatus performs waste toner weight prediction based on the amount of toner that has been used via reference to the number of printed sheets, the number of times of image quality maintenance control has been performed, and the like. However, prediction accuracy based solely on such factors may be poor.

DETAILED DESCRIPTION

In general, according to an embodiment, an image forming apparatus includes an image forming unit, a sensor, and a controller. The image forming unit is configured to form a toner image on an image carrier based on image data and transfer the toner image on the image carrier onto a sheet. The sensor is positioned to measure an amount of toner on the image carrier before transfer of the toner image onto the sheet. The controller is configured to determine a remaining amount of toner that is discarded based on an amount of toner at a specific region in the toner image as measured by the sensor, an image forming area obtained from the image data, and a toner transfer efficiency.

Hereinafter, an image forming apparatus and an operating method of an image forming apparatus according to embodiments will be described with reference to drawings.

First Embodiment

Figure 1:
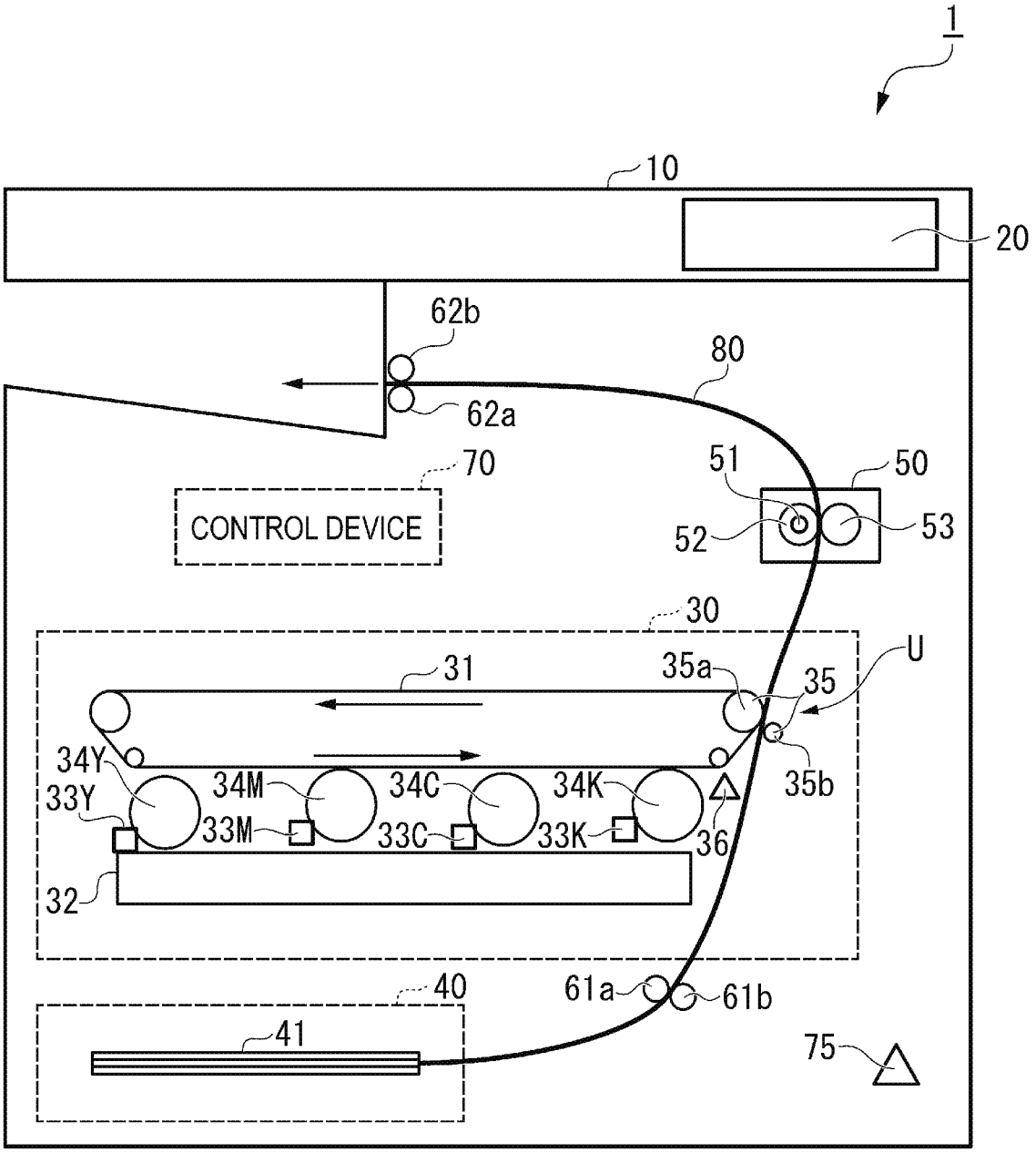
FIG. 1 illustrates an overall configuration example of an image forming apparatus according to an embodiment.

FIG. 1 illustrates an overall configuration example of an image forming apparatus according to an embodiment.

An image forming apparatus 1 according to an embodiment is a multi-function peripheral (MFP). The image forming apparatus 1 performs an image forming process and an image fixing process. The image forming process is a process of forming an image on a sheet. The image fixing process is a process of fixing the image formed on the sheet. The sheet is, for example, an original, a piece of paper on which a character, an image, or the like is formed, or the like. The sheet is not limited as long as the image forming apparatus 1 is able to read the sheet. The image forming apparatus 1 reads the image on the sheet, generates digital data, and generates an image file.

The image forming apparatus 1 includes an image reading unit 10, a control panel 20, an image forming unit 30, a sheet accommodating unit 40, a fixer 50, conveyor rollers 61*a* and 61*b*, paper discharge rollers 62*a* and 62*b*, a control device 70, and a temperature and humidity sensor 75.

The image reading unit 10 reads an image using reflected light. For example, the image reading unit 10 reads an image printed on a sheet set on a document reading table. The image reading unit 10 records the read image information. The recorded image information may be transmitted to or received from another information processing apparatus via a network. The recorded image information may be formed on a sheet by the image forming unit 30.

The control panel 20 includes a display unit and an operating unit. The display unit is a display device, such as a liquid crystal display, an organic electro luminescence (EL) display, or the like. The display unit displays various types of information related to the image forming apparatus 1 according to control of the control device 70. The operating unit includes a plurality of buttons or the like. The operating unit receives an operation of a user. The operating unit outputs a signal according to the operation performed by the user to the control device 70. The display unit and the operating unit may be configured as an integrated touch panel.

The image forming unit 30 performs the image forming process. In the image forming process, the image forming unit 30 forms an image on the sheet based on image information generated by the image reading unit 10 or image information received through a communication path. In particular, the image forming unit 30 forms an image on an image carrier with a recording material (for example, toner) and transfers the image onto the sheet.

The image forming unit 30 includes a transfer belt 31, an exposure unit 32, a plurality of developing devices (developing devices 33Y, 33M, 33C, and 33K), a plurality of photoconductive drums (photoconductive drums 34Y, 34M, 34C, and 34K), a transfer unit 35, and a toner-adhered-amount sensor 36.

The transfer belt 31 is the image carrier. The transfer belt 31 rotates in a direction indicated by an arrow (counter-clockwise) by rotation of rollers.

The exposure unit 32 is provided at a location facing the photoconductive drums 34Y, 34M, 34C, and 34K of each of the developing devices 33Y, 33M, 33C, and 33K. The exposure unit 32 irradiates a photoconductor layer of each of the photoconductive drums 34Y, 34M, 34C, and 34K with a laser beam. The exposure unit 32 is controlled to emit light based on the image information under control of the control device 70.

The exposure unit 32 emits the laser beam based on the image information. Exposure to light cause the charge on the surface (photoconductor layer) of each of the photoconductive drums 34Y, 34M, 34C, and 34K to dissipate. As a result, an electrostatic pattern is formed on the surfaces (photoconductive layers) of the photoconductive drums 34Y, 34M, 34C, and 34K at a location which is irradiated with the laser beam. In other words, by the irradiation of the laser beam by the exposure unit 32, an electrostatic latent image is formed on the surfaces (photoconductive layers) of the photoconductive drums 34Y, 34M, 34C, and 34K. Here, the exposure unit 32 may use light emitting diode (LED) light instead of the laser beam.

The developing devices 33Y, 33M, 33C, and 33K supply toner to the photoconductive drums 34Y, 34M, 34C, and 34K. For example, the developing device 33Y develops the electrostatic latent image on the surface (photoconductive layer) of the photoconductive drum 34Y with yellow (Y). Also, the developing device 33M develops the electrostatic latent image on the surface (photoconductive layer) of the photoconductive drum 34M with magenta (M). Further, the developing device 33C develops the electrostatic latent image on the surface (photoconductive layer) of the photoconductive drum 34C with cyan (C). In addition, the developing device 33K develops the electrostatic latent image on the surface (photoconductive layer) of the photoconductive drum 34K with black (K) toner.

The developing devices 33Y, 33M, 33C, and 33K form a toner image on the photoconductive drums 34Y, 34M, 34C, and 34K as a visible image. The toner image formed on the photoconductive drums 34Y, 34M, 34C, and 34K is transferred (primary transfer) onto the transfer belt 31.

Each photoconductive drum is an image carrier, and for example, is a cylindrical drum.

The transfer unit 35 includes a support roller 35*a* and a secondary transfer roller 35*b*. The transfer unit 35 transfers the toner image on the transfer belt 31 to the sheet at a secondary transfer location U. The secondary transfer location U is a location where the support roller 35*a* and the secondary transfer roller 35*b* face each other with the transfer belt 31 therebetween. The transfer unit 35 provides a transfer bias controlled by a transfer current to the transfer belt 31. The transfer unit 35 transfers the toner image on the transfer belt 31 to the sheet by the transfer bias. The control device 70 controls the transfer current used in the secondary transfer process.

The toner-adhered-amount sensor 36 measures an adhered amount of toner on the transfer belt 31 before transfer at the transfer unit 35. The toner-adhered-amount sensor 36 according to a first embodiment measures the adhered amount of toner forming the toner image on the transfer belt 31 before transfer. The toner-adhered-amount sensor 36 is provided between the photoconductive drum 34K and the transfer unit 35 to measure the adhered amount of toner before transfer.

The sheet accommodating unit 40 includes a single or plurality of paper feed cassettes. The paper feed cassette accommodates sheets 41 of a predetermined size and a predetermined type. The paper feed cassette includes a pickup roller. The pickup roller picks up the sheets 41 from the paper feed cassette one by one. The pickup roller supplies each of the picked up sheets 41 to a conveyor unit 80.

The fixer 50 performs the image fixing process. In particular, the fixer 50 fixes the toner image on the sheet 41 by heating and pressing the sheet 41. The fixer 50 includes a heat source 51, a heat roller 52, and a pressing roller 53. The heat source 51 is a heater lamp including a halogen lamp, a heater using an induction heating (IH) method, or the like. The heat source 51 is turned on or off according to a presence or an absence of electrification by the control device 70. The heat roller 52 is heated by heat generated when the heat source 51 is electrified. The heat roller 52 provides heat to the sheet 41. The pressing roller 53 is provided to face the heat roller 52. The pressing roller 53 presses the sheet 41 against the heat roller 52. The fixer 50 includes a temperature sensor (not shown). The temperature sensor measures a temperature of the heat roller 52. The temperature sensor transmits the measured temperature of the heat roller 52 to the control device 70.

The conveyor rollers 61*a* and 61*b* supply the sheet 41 fed from the paper feed cassette to the image forming unit 30. The conveyor rollers 61*a* and 61*b* are provided at facing locations.

The paper discharge rollers 62*a* and 62*b* discharge the sheet 41 where the image is formed by the fixer 50 to a discharging unit. The paper discharge rollers 62*a* and 62*b* are provided at facing locations.

The control device 70 controls each functional unit of the image forming apparatus 1.

The temperature and humidity sensor 75 is a sensor measuring temperature and humidity inside the image forming apparatus 1. The temperature and humidity sensor 75 is generally provided inside the image forming apparatus 1. The temperature and humidity sensor 75 is a type of an environment measurement sensor.

The conveyor unit 80 conveys the sheet 41. The conveyor unit 80 includes a conveyor path and a plurality of rollers (not shown). The conveyor path is a path through which the sheet 41 is conveyed. The rollers convey the sheet 41 by rotating according to control of the control device 70.

Figure 2:
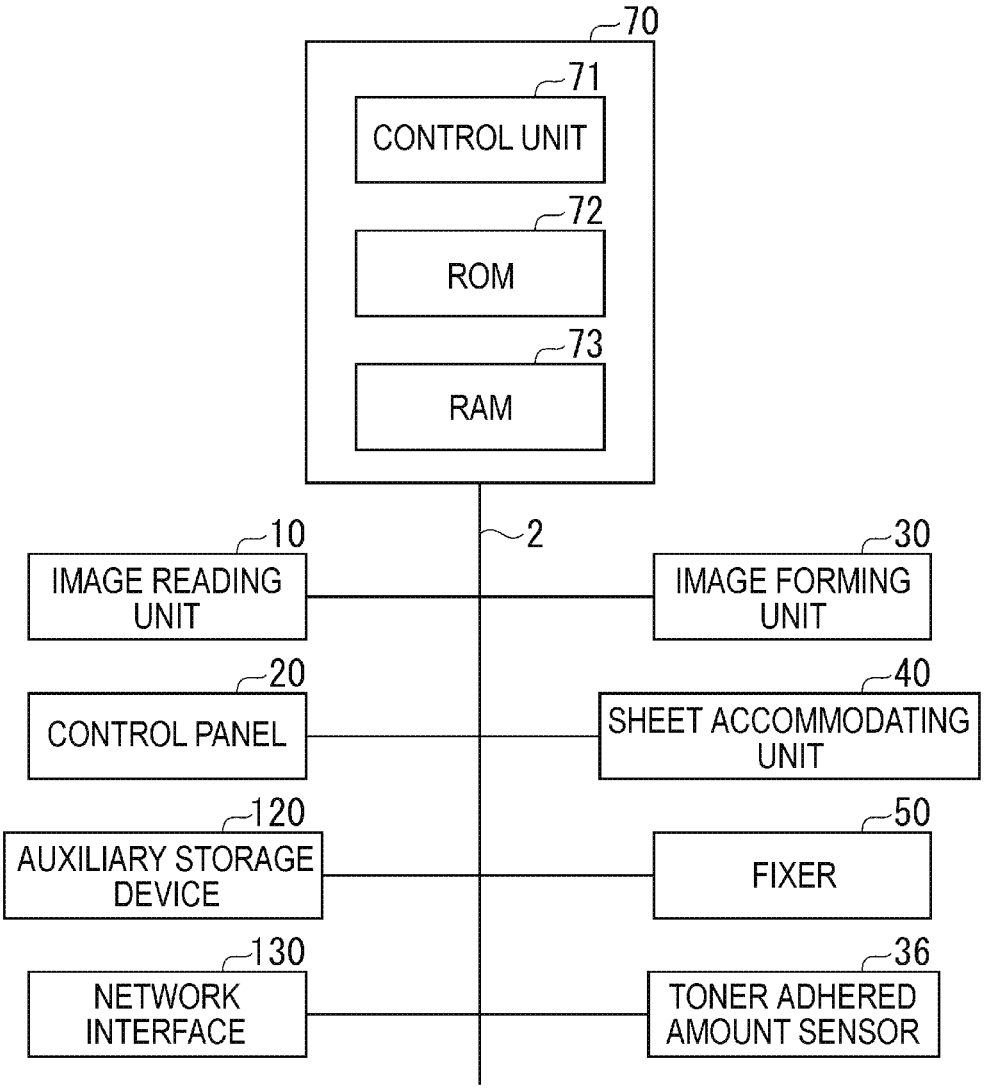
FIG. 2 is a block diagram showing a hardware configuration of an image forming apparatus according to an embodiment.

FIG. 2 is a block diagram showing a hardware configuration of the image forming apparatus 1 according to an embodiment. In FIG. 2, only a characteristic hardware configuration of the image forming apparatus 1 according to the embodiment is shown.

The image forming apparatus 1 includes the image reading unit 10, the control panel 20, the image forming unit 30, the toner-adhered-amount sensor 36, the sheet accommodating unit 40, the fixer 50, the control device 70, an auxiliary storage device 120, and a network interface 130.

The image reading unit 10, the control panel 20, the image forming unit 30, the toner-adhered-amount sensor 36, the sheet accommodating unit 40, and the fixer 50 are the same as those described above, and thus descriptions thereof are omitted. Hereinafter, the control device 70, the auxiliary storage device 120, and the network interface 130 will be described. Here, each functional unit is connected via a system bus 2 to enable data communication.

The control device 70 includes a control unit 71, a read only memory (ROM) 72, and a random access memory (RAM) 73. The control unit 71 is a processor, for example, a central processing unit (CPU), a graphics processing unit (GPU), or the like. The control unit 71 controls operations of each functional unit of the image forming apparatus 1. The control unit 71 performs various processes by loading and executing a program stored in the ROM 72 on the RAM 73. In particular, the control unit 71 estimates an amount of toner to be discarded (hereinafter, referred to as "waste toner"), based on a value obtained by the toner-adhered-amount sensor 36.

The ROM 72 stores a program for operating the control unit 71. The RAM 73 temporarily stores data used by each functional unit included in the image forming apparatus 1. The RAM 73 may store digital data generated by the image reading unit 10. The RAM 73 may temporarily store a job and a job log.

The auxiliary storage device 120 is, for example, a hard disk or a solid state drive (SSD), and stores various types of data. The various types of data are, for example, digital data, a job, a jog log, and the like.

The network interface 130 transmits or receives data to or from another apparatus. Here, the other apparatus is an information processing apparatus, for example, a personal computer. The network interface 130 operates as an input interface to receive data or instruction transmitted from the other apparatus. The instruction transmitted from the other apparatus is a print execution instruction or the like. Also, the network interface 130 operates as an output interface to transmit data to the other apparatus.

Figures 3, 4, 5:
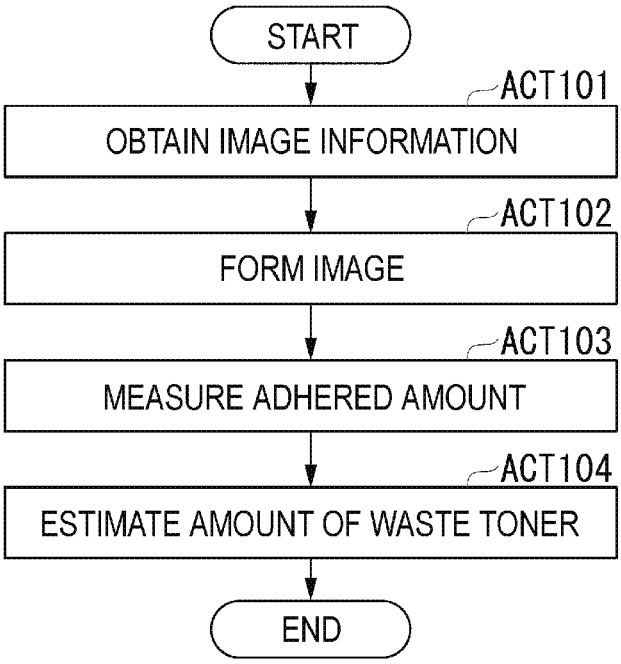
FIG. 3 is a flowchart showing a flow of a waste toner amount estimation process performed by an image forming apparatus, according to a first embodiment.
FIG. 4 is a diagram showing a specific example of an environment table according to an embodiment.
FIG. 5 is a diagram showing a specific example of a correction factor table according to an embodiment.

FIG. 3 is a flowchart showing a flow of a waste toner amount estimation process performed by the image forming apparatus 1, according to the first embodiment.

The control unit 71 obtains image information generated by the image reading unit 10 or the image information received through a communication path (ACT 101). The control unit 71 instructs the image forming unit 30 to form an image indicated by the image information, based on the obtained image information. The image forming unit 30 forms the image on the transfer belt 31 according to control of the control unit 71 (ACT 102).

The toner-adhered-amount sensor 36 measures an adhered amount of toner on the transfer belt 31 (ACT 103). The toner-adhered-amount sensor 36 measures the adhered amount of toner by irradiating the transfer belt 31 with light and receiving the light reflected on the transfer belt 31. The toner-adhered-amount sensor 36 converts the received light into a voltage value and outputs the converted voltage value to the control unit 71.

The control unit 71 estimates the amount of waste toner, based on Equation 1 below by using the voltage value output from the toner-adhered-amount sensor 36 (ACT 104).

[Equation 1]

$$\{A \times B \times (1-(C \times f(B)))\} \quad (1)$$

In Equation 1, A denotes a measurement result ($mg/cm^2$) of the adhered amount of toner, f(x) denotes a print width correction factor, B denotes a printing area ($cm^2$), and C denotes transfer efficiency (%). Here, the control unit 71 uses, as the measurement result, a measurement result obtained in a region satisfying a following condition within a range readable by the toner-adhered-amount sensor 36. For example, the control unit 71 uses a measurement result obtained in a region of which concentration therein is equal to or greater than predetermined concentration and having a predetermined size (hereinafter, referred to as a "first measurement target region"). The first measurement target region is, for example, a solid portion. However, the first measurement target region is not limited to the solid portion and may be any region satisfying the condition.

The print width correction factor is a correction factor where the image forming apparatus 1 is an apparatus that transfers in a low current manner. When the image forming apparatus 1 is an apparatus that transfers in a low voltage manner, a constant voltage is applied to the entire transfer belt 31. On the other hand, when the image forming apparatus 1 is an apparatus that transfers in a low current manner, a current flows from a high side to a low side, and thus a constant current is not applied to the entire transfer belt 31. In this case, transferring is affected. The print width correction factor is a factor for correcting such an effect. The print width correction factor may be obtained via an experiment.

The printing area denotes an area on the sheet where printing is performed. For example, the printing area may be obtained from the image information via image processing. The transfer efficiency is an index indicating a proportion of toner transferred to the sheet from the transfer belt 31. When the transfer efficiency is 100, all toner is transferred to the sheet from the transfer belt 31. The transfer efficiency may be pre-set or may be obtained in real time. When the transfer efficiency is obtained in real time, the transfer efficiency is calculated by weighting a pre-set transfer efficiency according to a state of environment (for example, humidity or a temperature) or a degree of prior use (degree of use) of device (for example, a roller). An equation within Σ( ) is used to estimate the amount of waste toner per page.

A more specific process will be described. The control unit 71 searches for the first measurement target region within the range readable by the toner-adhered-amount sensor 36 via the image processing using the image information. If the first measurement target region is detectable as a result of the search, the control unit 71 uses a measurement result measured in the first measurement target region. Here, if the image information to be printed on the first sheet is detected in the first measurement target region, the control unit 71 operates as follows. In particular, the control unit 71 estimates the amount of waste toner of the total number of pages by using a measurement result of the adhered amount of toner measured in the first measurement target region.

If the image information to be printed on a sheet from the second sheet is detected in the first measurement target region, the control unit 71 operates as follows. In particular, first, the control unit 71 stores a value of the printing area obtained from the image information printed on the sheet until the first measurement target region is detected. Then, the control unit 71 obtains a measurement result of the adhered amount of toner measured in the first measurement target region and then estimates the amount of waste toner of the total number of pages by using the obtained measurement result.

The control unit 71 may operate a value of a measurement result obtained previously or pre-set value on the value of the printing area obtained from the image information until the first measurement target region is detected. After the first measurement target region is detected, the control unit 71 estimates the amount of waste toner of the total number of pages by using the value of a measurement result of the adhered amount of toner measured from the first measurement target region. For example, it is assumed that the image information on the second sheet is detected in the first measurement target region. In this case, the control unit 71 multiplies the value of a measurement result obtained previously or the pre-set value by the value of the printing area obtained from the image information printed on the first sheet. Also, the control unit 71 multiplies the value of a measurement result measured from the first measurement target region to the value of printing area obtained from the image information to be printed on the sheet from the second sheet.

The image forming apparatus 1 configured as such may improve prediction accuracy of the amount of waste toner. In particular, the image forming apparatus 1 obtains information about the adhered amount of toner on the transfer belt 31 obtained by the toner-adhered-amount sensor 36. Then, the image forming apparatus 1 calculates the amount of waste toner by using at least the information about the adhered amount of toner, the printing area, and the transfer efficiency, and adds the calculated amount of waste toner to the number of sheets to be printed. Accordingly, the amount of waste toner during printing may be estimated. Also, since the value of adhered amount of toner actually obtained by the toner-adhered-amount sensor 36 is taken into consideration, the prediction accuracy of the amount of waste toner may be improved.

Second Embodiment

In a second embodiment, a toner-adhered-amount sensor measures an adhered amount of toner on a transfer belt after transfer and a control unit estimates an amount of waste toner based on a result of the measurement.

The configuration of the image forming apparatus 1 according to the second embodiment is the same as that of the first embodiment except that an arrangement location of the toner-adhered-amount sensor 36 is different and an estimation method of an amount of waste toner is different. Thus, hereinafter, only the differences will be described.

The toner-adhered-amount sensor 36 according to the second embodiment measures the adhered amount of toner left on the transfer belt 31 after transfer. In the second embodiment, the toner-adhered-amount sensor 36 is provided at a location where the adhered amount of toner on the transfer belt 31 after transfer is measurable. The location where the adhered amount of toner on the transfer belt 31 after transfer is measurable is, for example, any location between the transfer unit 35 and the photoconductive drum 34Y.

Next, specific processes of the image forming apparatus 1 according to the second embodiment will be described. A flow of basic processes is the same as that of the first embodiment and an equation for estimating the amount of waste toner is different.

The control unit 71 estimates the amount of waste toner based on Equation 2 below by using a voltage value output from the toner-adhered-amount sensor 36.

[Equation 2]

$$\Sigma\{A \times f(B) \times B\} \quad (2)$$

The image forming apparatus 1 according to the second embodiment configured as such may achieve the same effect as the first embodiment.

Third Embodiment

In a third embodiment, a control unit estimates an amount of waste toner by adding an adhered amount of toner in a fogging portion to a measurement result of an adhered amount of toner on the transfer belt 31 before transfer. In particular, an image forming apparatus estimates the amount of waste toner by adding the measurement result of the adhered amount of toner in the first embodiment and a measurement result of the adhered amount of toner in the fogging portion. Here, the fogging refers to adhesion of defectively charged toner to a white portion of an image formed on a surface of a transfer belt. When such fogging occurs, image quality is deteriorated due to toner being adhered to a portion where an image is not formed. Hereinafter, the adhered amount of toner in the fogging portion will be referred to as a fogging toner-adhered-amount.

The configuration of the image forming apparatus 1 according to the third embodiment is the same as that of the first embodiment except that the fogging toner-adhered-amount is also measured. Thus, hereinafter, only the difference from the first embodiment will be described.

The control unit 71 estimates an amount of waste toner in the fogging portion based on Equation 3 below, by using the voltage value output from the toner-adhered-amount sensor 36. Hereinafter, the amount of waste toner in the fogging portion will be referred to as a fogging waste toner amount.

[Equation 3]

$$\Sigma(F \times G) \quad (3)$$

In Equation 3, F denotes a measurement result (mg/cm$^2$) of an adhered amount of toner in a fogging portion and G denotes a white area (cm$^2$). Here, the control unit 71 uses, as the measurement result, a measurement result obtained in a region satisfying a following condition within a range readable by the toner-adhered-amount sensor 36. For example, the control unit 71 uses a measurement result obtained in a region of which concentration therein is smaller than predetermined concentration and having a predetermined size (hereinafter, referred to as a "second measurement target region"). The second measurement target region is, for example, a white portion. The white portion is a portion where an image is not formed on the image information. In other words, the white portion is a portion to which toner is not originally adhered. However, when fogging occurs, toner may adhere to the transfer belt 31 even in a region corresponding to the white portion on the image information. Hereinafter, an adhered amount of toner in the fogging portion will be referred to as a fogging toner-adhered-amount.

A more specific process will be described below. The control unit 71 searches for the second measurement target region within the range readable by the toner-adhered-amount sensor 36 via the image processing using the image information. If the second measurement target region is detectable as a result of the search, the control unit 71 uses a measurement result measured in the second measurement target region. Here, if the image information to be printed on the first sheet is detected in the second measurement target region, the control unit 71 operates as follows. In particular, the control unit 71 estimates the fogging waste toner amount of the total number of pages by using a measurement result of the adhered amount of toner measured in the second measurement target region.

Also, if the image information to be printed from the second sheet is detected in the second measurement target region, the control unit 71 operates as follows. In particular, first, the control unit 71 stores a value of the printing area obtained from the image information printed on the sheet until the second measurement target region is detected. Then, the control unit 71 obtains a measurement result of the adhered amount of toner measured in the second measurement target region and then estimates the fogging waste toner amount of the total number of pages by using the obtained measurement result.

Also, the control unit 71 may operate a value of a measurement result obtained previously or a pre-set value on the value of the printing area obtained from the image information until the second measurement target region is detected. After the second measurement target region is detected, the control unit 71 estimates the fogging waste toner amount of the total number of pages by using the value of a measurement result of the fogging adhered amount measured in the second measurement target region. For example, it is assumed that the image information on the second sheet is detected in the second measurement target region. In this case, the control unit 71 multiplies the value of a measurement result in the fogging portion obtained previously or the pre-set value by the value of printing area obtained from the image information to be printed on the first sheet. Also, the control unit 71 multiplies the value of a measurement result in the fogging portion measured from the second measurement target region to the value of printing area obtained from the image information to be printed on the sheet from the second sheet.

The image forming apparatus 1 estimates the amount of waste toner by adding the fogging waste toner amount estimated as described above and the amount of waste toner estimated in the same manner as the first embodiment.

The image forming apparatus 1 according to the third embodiment configured as such is capable of improving prediction accuracy of the amount of waste toner compared with that of the first embodiment. In particular, the image forming apparatus 1 estimates the amount of waste toner in consideration of the amount of waste toner in the fogging portion. Accordingly, it is possible to estimate the amount of waste toner in consideration of toner adhered on the white portion due to occurrence of the fogging. Thus, the prediction accuracy of the amount of waste toner may be improved compared with that of the first embodiment.

Fourth Embodiment

According to a fourth embodiment, a control unit estimates an amount of waste toner by adding a fogging toner-adhered-amount after transfer to a measurement result of an adhered amount of toner on the transfer belt 31 after transfer. In particular, an image forming apparatus estimates the amount of waste toner by adding the measurement result of the adhered amount of toner in the second embodiment and the measurement result of the fogging toner-adhered-amount after transfer.

The configuration of the image forming apparatus 1 according to the fourth embodiment is the same as that of the second embodiment except that the fogging toner-adhered-amount after transfer is also measured. Thus, hereinafter, only the difference from the second embodiment will be described.

The control unit 71 estimates the fogging waste toner amount after transfer based on Equation 4 below by using the voltage value output from the toner-adhered-amount sensor 36. A flow of basic processes in the fogging portion after transfer is the same as the third embodiment.

[Equation 4]

$$\Sigma(F \times G) \tag{4}$$

The image forming apparatus 1 estimates the amount of waste toner by adding the fogging waste toner amount after transfer estimated as described above and the amount of waste toner estimated in the same manner as the second embodiment.

The image forming apparatus 1 according to the fourth embodiment configured as such is capable of improving the prediction accuracy of the amount of waste toner compared with that of the second embodiment. In particular, the image forming apparatus 1 estimates the amount of waste toner in consideration of the amount of waste toner in the fogging portion after transfer. Accordingly, it is possible to predict the amount of waste toner also in consideration of toner adhered on the white portion due to occurrence of the fogging. Thus, the prediction accuracy of the amount of waste toner may be improved compared with that of the second embodiment.

Fifth Embodiment

According to a fifth embodiment, a control unit estimates an amount of waste toner based on an environmental condition in an image forming apparatus and a measurement result of an adhered amount of toner on the transfer belt 31 before transfer. In the present embodiment, an example of using humidity as the environmental condition in the image forming apparatus is described, but a temperature may be included in the environmental condition in the image forming apparatus.

The configuration of the image forming apparatus 1 according to the fifth embodiment is the same as that of the first embodiment except that an environment table is provided. Thus, hereinafter, only the difference from the first embodiment will be described.

An environment table is a table in which information according to an environmental condition in the image forming apparatus 1 is registered. The environment table is stored in the auxiliary storage device 120.

FIG. 4 is a diagram showing a specific example of an environment table according to an embodiment.

The environment table includes a plurality of records indicating the information according to the environmental condition in the image forming apparatus 1. The records each include values of humidity and current, and a correction value according to an environmental factor. The humidity indicates humidity in the image forming apparatus 1 measured in the image forming apparatus 1. The current indicates a maximum current applied to the transfer belt 31 and the secondary transfer roller. The correction value according to the environmental factor indicates a correction value for correcting an effect of humidity. The correction value according to the environmental factor is obtained by an experiment in advance.

The control unit 71 estimates the amount of waste toner based on Equation 5 below by using the voltage value output from the toner-adhered-amount sensor 36 and humidity measured by the temperature and humidity sensor 75.

[Equation 5]

$$\{A \times B \times (1-f(B)) \times g(D)\} \tag{5}$$

In Equation 5, g (D) denotes a correction value according to an environmental factor.

The image forming apparatus 1 estimates the amount of waste toner in consideration of the environmental condition as described above.

The image forming apparatus 1 according to the fifth embodiment configured as such takes the environmental condition into consideration when estimating the amount of waste toner. It is known that the adhered amount of toner before and after transfer increases or decreases when being in contact with the environment. However, an actual affect varies for each image forming apparatus 1. Thus, according to the embodiment, the amount of waste toner is estimated based on a correlation between the measurement result of the temperature and humidity sensor 75 inside the image forming apparatus 1 and the measurement result of the toner-adhered-amount sensor. Thus, it is possible to predict the amount of waste toner in consideration of an effect of environment inside the image forming apparatus 1. Accordingly, the prediction accuracy of the amount of waste toner may be improved.

Modifications of the image forming apparatus 1 according to the fifth embodiment will be described.

The control unit 71 may estimate the amount of waste toner based on the environmental condition, the measurement result of the adhered amount of toner on the transfer belt 31 before transfer, and the measurement result of the fogging toner-adhered-amount.

The control unit 71 may estimate the amount of waste toner based on the environmental condition in the image forming apparatus and the measurement result of the adhered amount of toner on the transfer belt 31 after transfer.

The control unit 71 may estimate the amount of waste toner based on the environmental condition, the measurement result of the adhered amount of toner on the transfer belt 31 after transfer, and the measurement result of the fogging toner-adhered-amount.

Sixth Embodiment

According to a sixth embodiment, a control unit estimates an amount of waste toner based on a degree of prior usage (degree of use) for each component in the image forming apparatus and a measurement result of an adhered amount of toner on the transfer belt 31 before transfer. Here, the degree of prior usage refers to a degree of deterioration of each component, that is, a use state of each component. The degree of use advances with the increase in the number of usages and/or cumulated use time of each component. In this context, the relevant component is, for example, a photoconductive drum, a roller, or the like.

The configuration of the image forming apparatus 1 according to the sixth embodiment is the same as that of the first embodiment except that a correction factor table is provided. Hereinafter, only the difference from the first embodiment will be described.

According to the sixth embodiment, the correction factor table is a table in which information according to the degree of use of each component is registered. The correction factor table is stored in the auxiliary storage device 120.

FIG. 5 is a diagram showing a specific example of a correction factor table according to an embodiment.

The correction factor table includes a plurality of records indicating information according to the degree of use of each component. The records each include values of the number of motor rotations and a correction factor. The number of motor rotations indicates the number of motor rotations of a roller. For example, the number of motor rotations indicates the number of rotations of a driving motor driving the support roller 35*a*. The correction factor indicates a correction factor for correcting an effect of the degree of use. The correction factor table is set such that the correction factor is changed whenever the number of motor rotations exceeds a predetermined number. For example, the correction factor table is set such that the correction factor is $\alpha$ when the number of motor rotations reaches 50,000 and the correction factor is $\beta$ when the number of motor rotations reaches 100,000.

The control unit 71 estimates the amount of waste toner based on Equation 6 below by using the voltage value output from the toner-adhered-amount sensor 36 and the measurement result of the degree of use of each component.

[Equation 6]

$$\Sigma\{A\times B\times(1-(C\times f(B)))\times h(H)\} \quad (6)$$

In Equation 6, h(H) denotes the correction factor.

The image forming apparatus 1 estimates the amount of waste toner in consideration of the degree of use of each component as described above.

The image forming apparatus 1 according to the sixth embodiment configured as such takes the degree of use of each component into consideration when estimating the amount of waste toner. It is known that the adhered amount of toner before and after transfer increases or decreases with the degree of use. However, the actual effect varies for each image forming apparatus 1. Thus, according to the embodiment, the amount of waste toner is estimated based on a correlation between the measurement result of the degree of use of each component calculated inside the image forming apparatus 1 and the measurement result of the toner-adhered-amount sensor. Thus, it is possible to predict the amount of waste toner also in consideration of the degree of use of each component inside the image forming apparatus 1. Accordingly, the prediction accuracy of the amount of waste toner may be improved.

Modifications of the image forming apparatus 1 according to the sixth embodiment will now be described.

In the embodiment, the number of motor rotations is described as an example of the degree of use of each component, but the degree of use of each component may be the number of printed sheets.

The control unit 71 may estimate the amount of waste toner based on the degree of use of each component, the measurement result of the adhered amount of toner on the transfer belt 31 before transfer, and the measurement result of the fogging toner-adhered-amount.

The control unit 71 may estimate the amount of waste toner based on the degree of use of each component and the measurement result of the adhered amount of toner on the transfer belt 31 after transfer.

The control unit 71 may estimate the amount of waste toner based on the degree of use of each component, the measurement result of the adhered amount of toner on the transfer belt 31 after transfer, and the measurement result of the fogging toner-adhered-amount.

Modifications common to each embodiment will be described.

In each embodiment as described above, the toner-adhered-amount sensor 36 measures the adhered amount of toner on the transfer belt 31. The toner-adhered-amount sensor 36 may measure the adhered amount of toner before transfer or after transfer on any one of the photoconductive drums 34Y, 34M, 34C, and 34K. In this case, the toner-adhered-amount sensor 36 is provided at a location where the sensor can irradiate the photoconductive drum 34 with light.

The control unit 71 may display the estimated amount of waste toner on the control panel 20. For example, the control unit 71 may display the amount of waste toner on the control panel 20 in a numerical value or in graphics.

The control unit 71 may be configured to output an alarm when a result of estimating the amount of waste toner is equal to or greater than a predetermined threshold value, based on the result of estimating. The predetermined threshold value is, for example, 80% or 90% of a waste toner container. Also, the control unit 71 may display a notification on the control panel 20 in addition to the alarm.

According to the image forming apparatus 1 of the at least one embodiment described above, the image forming apparatus 1 includes the image forming unit 30, the toner-adhered-amount sensor 36, and the control unit 71. The image forming unit 30 forms the image of toner on the transfer belt 31 or the photoconductive drum 34, based on the image information. The toner-adhered-amount sensor 36 measures the adhered amount of toner before transfer being adhered on the transfer belt 31 or the photoconductive drum 34. The control unit 71 estimates the amount of waste toner based on the adhered amount measured by the toner-adhered-amount sensor 36. Accordingly, the prediction accuracy of the amount of waste toner may be improved.

Some functions of the image forming apparatus 1 in the above-described embodiment may be realized by a computer. In this case, a program for realizing the function is recorded on a non-volatile computer-readable recording medium. Then, the program may be realized by causing a computer system to read and execute the program recorded on the recording medium on which the program is recorded. Here, the "computer system" includes hardware such as an operating system, a peripheral device, or the like. Also, the "computer-readable recording medium" denotes a portable medium, a storage device, or the like. The portable medium is a flexible disk, a magneto-optical disk, ROM, CD-ROM, or the like. Further, the storage device is a hard disk or the like built in the computer system. Further, the "computer-readable recording medium" dynamically stores and maintains the program for a short period of time, like a communication line in which the program is transmitted via a communication link. The communication link is a network such as the Internet or a telephone line. Also, the "computer-readable recording medium" may be volatile memory in the computer system serving as a server or a client. The volatile memory stores and maintains a program for a fixed period of time. Further, the program may be for realizing a part of the functions described above. Further, the program may realize the above-described functions in combination with a program already recorded on the computer system.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

an image forming unit configured to form a toner image on an image carrier based on image data and transfer the toner image on the image carrier onto a sheet;

a sensor positioned to measure an amount of toner on the image carrier before transfer of the toner image onto the sheet; and a controller configured to determine a specific region, which is a region at which a toner density is greater than a predetermined value and that has an area greater than a predetermined area, based on the image data and determine a remaining amount of toner that is discarded based on an amount of toner at the specific region in the toner image as measured by the sensor, an image forming area obtained from the image data, and a toner transfer efficiency.

2. The image forming apparatus according to claim 1, wherein the image forming area is a total image forming area of a plurality of pages of images to be formed based on the image data.

3. The image forming apparatus according to claim 1, wherein the controller is configured to determine the remaining amount of toner using an amount of toner at a non-image forming region obtained from the measured amount and an area of the non-image forming region.

4. The image forming apparatus according to claim 3, wherein the controller is configured to determine the remaining amount of toner based on a sum of a remaining amount of toner at an image forming region and a remaining amount of toner at the non-image forming region.

5. The image forming apparatus according to claim 1, further comprising:

a second sensor configured to measure an environmental parameter, wherein the controller is further configured to carry out an correction based on the environmental parameter to determine the remaining amount of toner.

6. The image forming apparatus according to claim 5, wherein the environmental parameter is humidity.

7. The image forming apparatus according to claim 1, wherein the controller is further configured to carry out an correction based on a degree of use of a component of the image forming unit to determine the remaining amount of toner.

8. The image forming apparatus according to claim 7, wherein the component of the image forming unit is a motor configured to drive a transfer roller with which the toner image is transferred from the image carrier.

9. The image forming apparatus according to claim 1, wherein the image carrier is a transfer belt.

10. An image forming apparatus, comprising:

an image forming unit configured to form a toner image on an image carrier based on image data and transfer the toner image on the image carrier onto a sheet;

a sensor positioned to measure an amount of toner on the image carrier after transfer of the toner image onto the sheet; and a controller configured to determine a remaining amount of toner that is discarded based on an amount of toner at an image forming region on the image carrier as measured by the sensor and a total image forming area of a plurality of pages of images to be formed based on the image data.

11. The image forming apparatus according to claim 10, wherein the controller is configured to determine the remaining amount of toner using an amount of toner at a non-image forming region obtained from the measured amount and an area of the non-image forming region.

12. The image forming apparatus according to claim 11, wherein the controller is configured to determine the remaining amount of toner based on a sum of a remaining amount of toner at the image forming region and a remaining amount of toner at the non-image forming region.

13. The image forming apparatus according to claim 10, further comprising:

a second sensor configured to measure an environmental parameter, wherein the controller is further configured to carry out an correction based on the environmental parameter to determine the remaining amount of toner.

14. The image forming apparatus according to claim 13, wherein the environmental parameter is humidity.

15. The image forming apparatus according to claim 10, wherein the controller is further configured to carry out an correction based on a degree of use of a component of the image forming unit to determine the remaining amount of toner.

16. The image forming apparatus according to claim 15, wherein the component of the image forming unit is a motor configured to drive a transfer roller with which the toner image is transferred from the image carrier.

17. The image forming apparatus according to claim 10, wherein the image carrier is a transfer belt.

18. An operating method of an image forming apparatus including an image forming unit configured to form a toner image on an image carrier based on image data and transfer the toner image on the image carrier onto a sheet, the method comprising:

measuring an amount of toner on the image carrier before transfer of the toner image onto the sheet;

determining a specific region, which is a region at which a toner density is greater than a predetermined value and that has an area greater than a predetermined area, based on the image data; and determining a remaining amount of toner that is discarded based on an amount of toner at the specific region in the toner image as measured, an image forming area obtained from the image data, and a toner transfer efficiency.

19. The operating method according to claim 18, wherein the image forming area is a total image forming area of a plurality of pages of images to be formed based on the image data.

20. The operating method according to claim 18, wherein the image carrier is a transfer belt.

* * * * *